United States Patent [19]

Nishimura et al.

[11] Patent Number: 5,070,837

[45] Date of Patent: Dec. 10, 1991

[54] REVOLUTION SPEED CONTROL APPARATUS FOR AN INTERNAL COMBUSTION ENGINE

[75] Inventors: Yukinobu Nishimura; Setsuhiro Shimomura, both of Himeji, Japan

[73] Assignee: Mitsubishi Denki Kabushiki Kaisha, Tokyo, Japan

[21] Appl. No.: 642,587

[22] Filed: Jan. 17, 1991

[30] Foreign Application Priority Data

Feb. 8, 1990 [JP] Japan ..... 2-30251

[51] Int. Cl.[5] ..... F02D 41/16

[52] U.S. Cl. ..... 123/339

[58] Field of Search ..... 123/339, 352

[56] References Cited

U.S. PATENT DOCUMENTS

| | | | |
|---|---|---|---|
| 4,563,989 | 1/1986 | Peter | 123/339 |
| 4,665,871 | 5/1987 | Shimomura et al. | 123/339 |
| 4,667,632 | 5/1987 | Shimomura et al. | 123/339 |
| 4,856,475 | 8/1989 | Shimomura et al. | 123/339 |
| 4,877,003 | 10/1989 | Shimomura et al. | 123/339 |
| 4,879,983 | 11/1989 | Shimomura et al. | 123/339 |

*Primary Examiner*—Tony M. Argenbright

*Attorney, Agent, or Firm*—Sughrue, Mion, Zinn, Macpeak and Seas

[57] ABSTRACT

A revolution speed control apparatus for an internal combustion engine comprises an intake air quantity setting device for setting an intake air quantity to an internal combustion engine, a target revolution speed setting device for setting a target revolution speed for the engine, a revolution speed detector for detecting the revolution speed of the engine, and idling state detector for detecting an idling state of the engine, a revolution speed feedback-control quantity calculating device for calculating a revolution speed feedback control quantity in accordance with an error between the target revolution speed and an actual revolution speed of the engine when the engine is in an idling state, a hot wire type air flow sensor for detecting an intake air quantity to the engine, a correction value memory to transfer with time the revolution speed feedback control quantity in accordance with an error between an actual intake air quantity and a target intake air quantity which is obtained from the intake air quantity set by the intake air quantity setting device and the revolution speed feedback control quantity, and an intake air quantity control device for controlling the intake air quantity on the basis of a memory value stored in the correction value memory and the target intake air quantity.

2 Claims, 7 Drawing Sheets

REVOLUTION SPEED CONTROL APPARATUS FOR AN INTERNAL COMBUSTION ENGINE

BACKGROUND OF THE INVENTION

1. Field of the Invention

The present invention relates to a revolution speed control apparatus for an internal combustion engine to control the idle revolution speed of the engine.

2. Discussion of Background

FIG. 5 shows a conventional electronic control apparatus for an internal combustion engine wherein it includes a fuel injection device and an idle revolution speed control device.

In FIG. 5, a reference numeral 1 designates an air cleaner, a numeral 2 a hot wire type air flow sensor to detect an intake air quantity to an engine 8, a numeral 3 a control unit (ECU), a symbol $Q_A$ represents an intake air quantity Signal supplied from the air flow sensor 2 to the ECU 3, a numeral 4 designates a throttle valve disposed in an intake air pipe 14 of the engine 8 to thereby control an intake air quantity, a numeral 5 an idle switch operable when the throttle valve 4 is entirely closed, i.e. it assumes an idling position, a numeral 6 designates a linear solenoid type intake air control valve provided in a bypass passage 15 which bypasses the throttle valve 4, a numeral 7 an intake air quantity adjusting section which is disposed in the bypass passage 16 and which is constituted by a wax valve for controlling an intake air quantity in response to the temperature of the engine and a manually operating mechanism or an air-adjust screw (AAS) in the intake air passage, a numeral 9 an injector attached to the intake air pipe at the upstream side of the intake air port of the engine 8, a numeral 10 a temperature sensor to detect the temperature of cooling water for the engine 8 and to output a signal $\theta$ representing an engine temperature (an engine temperature signal) to the ECU, a numeral 11 a revolution speed detector attached to the crankshaft or the distributor thereby detecting the revolution speed of the engine 8 and generating a signal $n_e$ representing a revolution speed (a revolution speed signal) to the ECU 3, a numeral 12 a load detector to generate a working signal to the ECU 3 in response to the activation of a load such as an air conditioner, a power-assisted steering wheel or the like when such load is applied to the engine, and a numeral 13 a pressure sensor for detecting a pressure in the intake air pipe 14, the pressure sensor being to input to the ECU 3 a pressure signal $P_a$ as an intake air quantity signal in a case that the air flow sensor 2 is not used. A symbol $V_B$ represents a voltage signal from a battery as a power source, which is applied to the ECU 3.

In the conventional control apparatus having the construction as described above, the ECU 3 receives an intake air quantity signal $Q_A$ from the air flow sensor 2, an idle signal from the idle switch 5, an engine temperature signal $\theta$ from the temperature sensor 10, a revolution speed signal from the revolution speed detector 11, a load signal from the load detector 12 and a pressure signal $P_a$ from the pressure sensor 13, and performs an idle revolution speed control and a fuel injection control.

For the idle revolution speed control, the ECU 3 performs the feedback control to the intake air control valve 6 so that the actual revolution speed of the engine becomes a set revolution speed on the basis of an error between the set revolution speed which is previously determined so as to correspond to the engine temperature $\theta$ and the actual revolution speed. For the fuel injection control, the ECU 3 controls the actuation of the injector 9.

FIG. 6 is a block diagram showing the control system of another conventional control apparatus shown in, for instance, Japanese Unexamined Patent Publication 162340/1984 or U.S. Pat. No. 4,665,871. The construction of the hardware is the same as that shown in FIG. 5. In FIG. 6, a numeral 31 designates a basic intake air quantity calculating section for calculating a basic intake air quantity $Q_T$ which is previously set with the characteristic as shown in FIG. 7 wherein the basic intake air quantity is determined with respect to the engine temperature $\theta$, a numeral 32 designates an intake air correction quantity calculating section for calculating an intake air correction quantity with respect to a load to the engine such as the air conditioner, the power-assisted steering wheel or the like, and a symbol $S_1$ designates a switch which is closed when the load detector 12 is actuated. A numeral 35 designates a main passage intake air quantity calculating section for calculating an intake air quantity in the main passage of the intake air pipe 14. The main passage intake air quantity calculating section 35 calculates an intake air quantity for the engine other than an intake air quantity passing through the intake air control valve 6, namely, a main passage intake air quantity $Q_M$ having the characteristic, as shown in FIG. 9, with relation to the engine temperature $\theta$, which is the sum of the quantity of air which leaks from the intake air pipe 14 closed by the throttle valve 4 and the quantity of air passing through the intake air quantity adjusting section 7. A numeral 36 designates a duty output value calculating section for calculating a duty output value as an output from the intake air control valve 6. The relation of the intake air control quantity performed by the intake air control valve 6 to the duty output value is as shown in FIG. 8. A numeral 40 designates an actual intake air quantity passing through the main passage (an actual main passage intake air quantity) $Q_{RM}$ and a numeral 33 designates a target revolution speed calculating section in which the target revolution speed $n_T$ is set with respect to the engine temperature $\theta$ as shown in FIG. 8. A numeral 34 designates a revolution speed feedback control quantity calculating section for calculating a revolution speed feedback control quantity and a numeral 39 designates a flow rate feedback control quantity calculating section for calculating a flow rate feedback control quantity.

The operation of the conventional control apparatus shown in FIGS. 5 and 6 will be described.

In an idling state of the engine in which the switch $S_1$ is closed, the basic intake air quantity $Q_T$ calculated in relation to the engine temperature and the intake air correction quantity calculated in relation to a load of engine are summed at a node $N_1$ to thereby provide a set intake air quantity $Q'_T$. At a node $N_2$, the set intake air quantity $Q'_T$ and the revolution speed feedback control quantity $Q_{NFB}$ given by the calculating section 34 are summed to obtain a target intake air quantity $Q_O$. At node $N_5$, the main passage intake air quantity $Q_M$ calculated with respect to the engine temperature $\theta$ is subtracted from the target intake air quantity $Q_O$ so that an intake air control quantity by the intake air control valve 6 is calculated.

At a node $N_4$, the flow rate feedback control quantity $Q_{QFB}$ provided by the calculating section 39 is added to the intake air control quantity, and thus obtained summed value is inputted as an intake air control quantity to the duty output value calculating section 36 in which the summed value is converted into a duty output value in accordance with a relation as shown in FIG. 10. In this case, correction by a battery voltage $V_B$ is made in order to correct the performance of the intake air control valve 6. Further, since a coil resistance in the intake air control valve 6 tends to rely on temperature, correction is made so that the coil temperature is represented by the temperature of the engine.

At a node $N_6$, an actual main passage intake air quantity $Q_{RM}$ is added to the above-mentioned duty output Value, and the thus obtained summed value is given to the engine 8.

On the other hand, at a node $N_9$, an error between the target revolution speed $n_T$ and the actual revolution speed $N_e$ of the engine is obtained and the error is inputted to the revolution speed feedback control quantity calculating section 34. The calculating section 34 performs a controlling operation including at least an I control among known PID control operations to thereby output the revolution speed feedback control quantity $Q_{NFB}$ which assumes a positive value (+) when $n_T > n_e$, and is added to the intake air quantity $Q'_T$ at the node $N_2$ whereby the target intake air quantity $Q_O$ is provided. Thus, the feedback control is performed so that the engine revolution speed $n_e$ approaches the target revolution speed $n_T$.

At a node $N_8$, an error between the target intake air quantity $Q_O$ from a node $N_3$ and an actual intake air quantity $Q_A$ to the engine from a node $N_7$, i.e. an air intake quantity $Q_A$ measured by the air flow sensor 2, is obtained, and the error is inputted to the flow rate feedback control quantity calculating section 39 to be subjected to a control of integration (I). In this case, the value of the flow rate feedback control quantity $Q_{QFB}$ as an output from the calculating section 39 takes a positive value (+) when the value of the error is positive (+). The value outputted from the calculating section 39 is added to the intake air control quantity given by the intake air control valve 6. Thus, the actual intake air quantity $Q_A$ to the engine 8 is so controlled as to reach the target intake air quantity $Q_O$ through the flow rate feedback control. In practical operations, when the degree of opening of the intake air quantity control valve 6 is changed, the intake air quantity to the engine 8 changes sooner than the revolution speed of the engine 8. Accordingly, an idle revolution speed control with quick response can be effected by rendering the gain of the flow rate feedback control to be greater than the gain of the revolution speed feedback control.

As described above, when the flow rate feedback control was effected in addition to the revolution speed feedback control in the conventional idle revolution speed control apparatus, there was found a certain improvement in response with respect to factors which cause an error between the set intake air quantity and the actual intake air quantity in comparison with a case that only the revolution speed feedback control was effected. The factors causing the error are, for instance, scattering in the flow resistance of the intake air control valve 6, variations of air density due to changes of the atmospheric pressure and the temperature of air sucked into the engine, clogging due to a change with time in the intake air quantity adjusting section 7, scattering in the flowing characteristics of wax used and so on. As the other factors which cause the error between the set revolution speed and the actual revolution speed in the revolution speed feedback control, there are such error caused in relation of the intake air quantity to the engine revolution speed due to scattering of the engine in manufacturing steps, a change with time and so on. Further, an error in an estimated correction quantity due to scattering of loads and a change with time of them constitute such factors. Accordingly, the controllability can be improved by assigning the function of correcting an error resulted from the relation between the set intake air quantity and the actual intake air quantity to the flow rate feedback control quantity $Q_{QFB}$ and by assigning the function of correcting an error resulted from the relation between the set revolution speed and the actual revolution speed to the revolution speed feedback control quantity $Q_{NFB}$ respectively so that parts of the error are shared with two control quantities. However, there is such requirement that there should be a difference of 10–20 times or more between the gains of the revolution speed feedback control and the flow rate feedback control. They are formed in double loops in the block diagram as shown in FIG. 6, so as not to cause mutual influence. The gain of the revolution speed feedback control is substantially determined by the response property of the engine 8. Accordingly, if the gain of the flow rate feedback control is determined so as to obtain the optimum gain of the revolution speed feedback control, the gain of the flow rate feedback control comes to the limit of oscillation. Accordingly, in the conventional revolution speed control apparatus, it was difficult to realize a flow rate feedback control having quick response property while the optimum gain was obtained for the revolution speed feedback control.

On the other hand, since the factor causing the error in the flow rate feedback control does not require strictly a quick response property, the response property in the flow rate feedback control may be slower than that of the revolution speed feedback control. In view of this fact, it can be considered that the gain of the flow rate feedback control is smaller than the gain of the revolution speed feedback control. In this case, however, the gain of the flow rate feedback control has to be less than 1/10–1/20 times as the gain of the revolution speed feedback control when the later is determined to have the optimum value. From the above-mentioned fact, it was difficult for the conventional revolution speed control apparatus to perform the optimum flow rate feedback control.

SUMMARY OF THE INVENTION

It is an object of the present invention to provide a revolution speed control apparatus for an internal combustion engine improving controllability.

The foregoing and other-objects of the present invention have been attained by providing a revolution speed control apparatus for an internal combustion engine which comprises:

an intake air quantity setting means for setting an intake air quantity to an internal combustion engine, a target revolution speed setting means for setting a target revolution speed for the engine, a revolution speed detecting means for detecting the revolution speed of the engine, an idling state detecting means for detecting an idling state of the engine, a revolution speed feedback-control quantity calculating means for calculating a revolution speed feedback control quantity in accordance with an error between the target revolution speed and an actual revolution speed of the engine when the engine is in an idling state, an intake air quantity detecting means for detecting an intake air quantity to the engine, a correction value memory to transfer with time the revolution speed feedback control quantity in accordance with an error between an actual intake air quantity and a target intake air quantity which is obtained from the intake air quantity set by the intake air quantity setting means and the revolution speed feedback control quantity, and an intake air quantity control means for controlling the intake air quantity on the basis of a memory value stored in the correction value memory and the target intake air quantity.

In the present invention, only the revolution speed feedback control is performed wherein a revolution speed feedback control quantity is transferred with time to a correction value memory on the basis of an error between a target intake air quantity and an actual intake air quantity so that an intake air quantity to the engine is controlled by the target intake air quantity and a value in the correction value memory.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
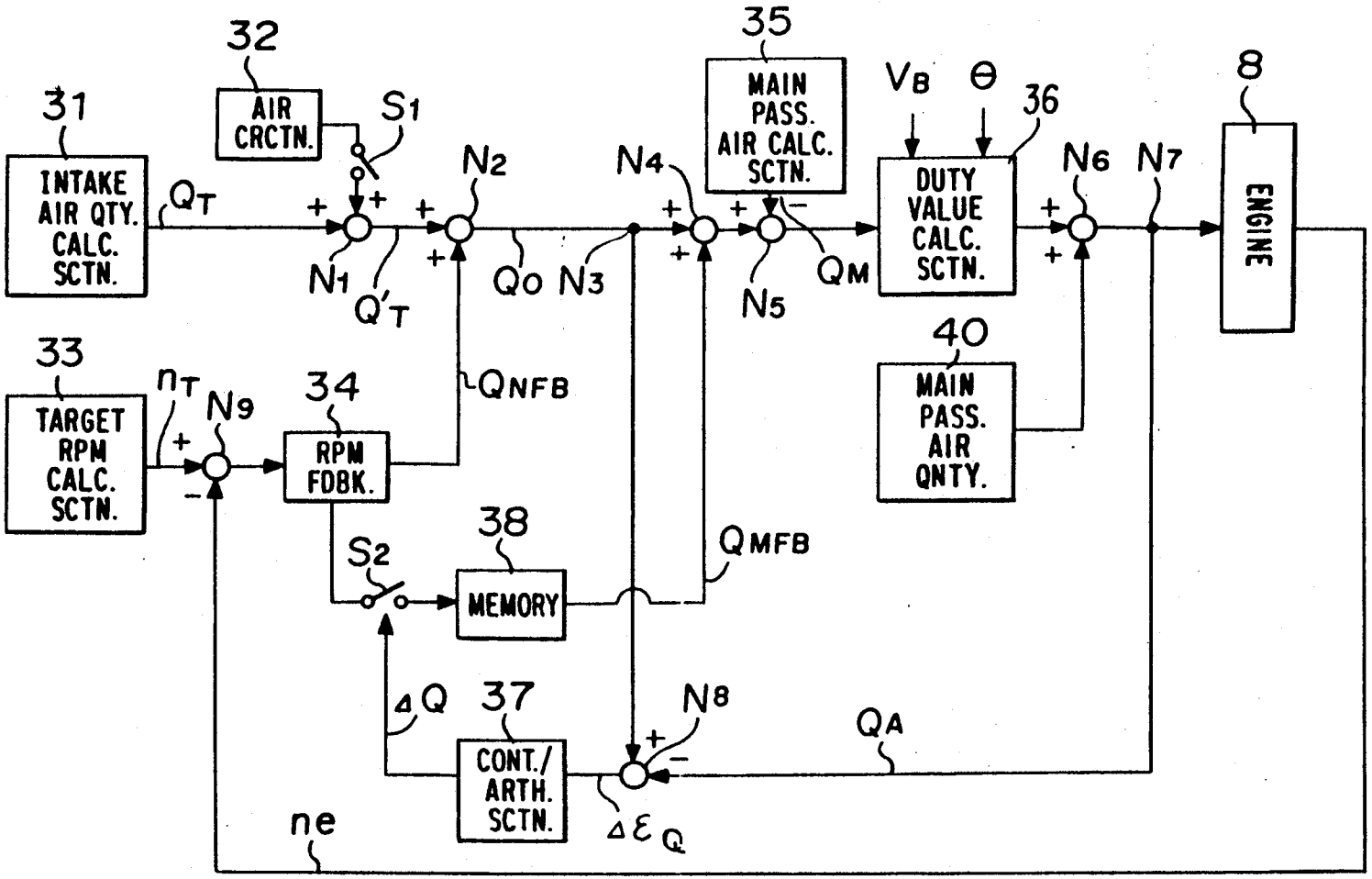
FIGS. 1 and 2 are respectively block diagrams of first and second embodiments of the revolution speed control apparatus for an internal combustion engine according to the present invention.

Referring to the drawings wherein the same reference numerals designate the same or corresponding parts throughout several views, and more particularly to FIG. 1 thereof, there is shown a block diagram of an embodiment of the revolution speed control apparatus of the present invention.

Figure 6:
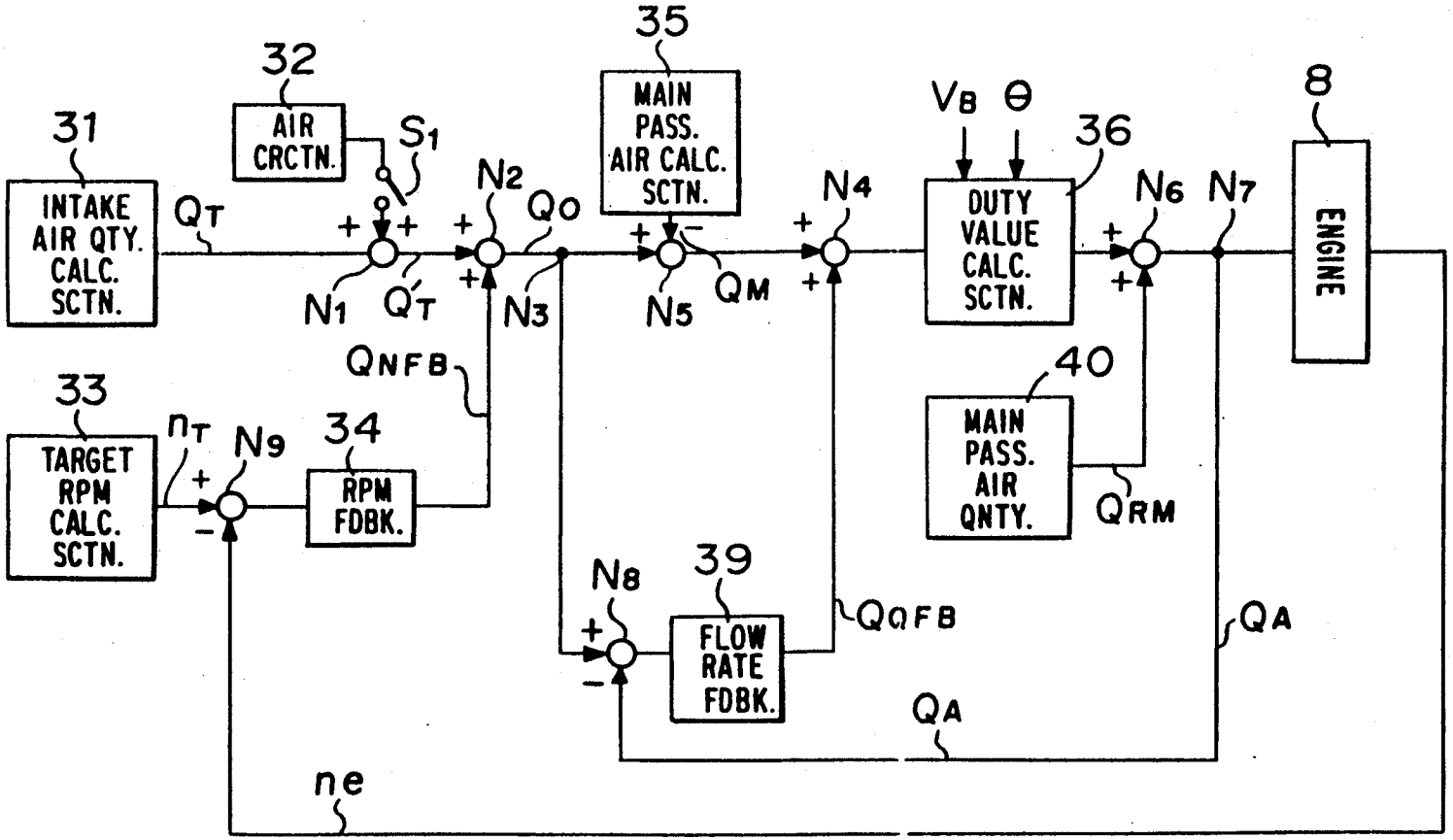
FIGURE 6 PRIOR ART
Figure 7:
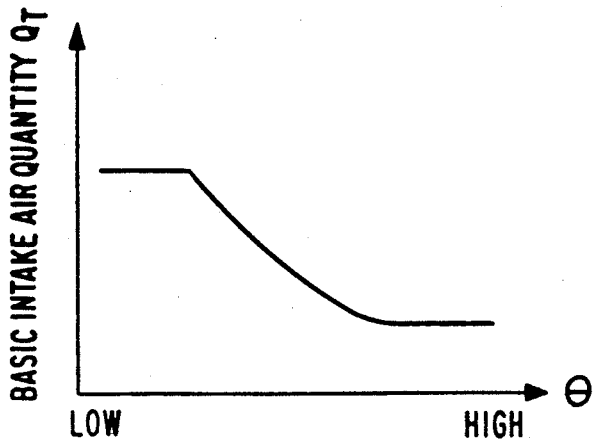
FIGURE 7 PRIOR ART
FIGS. 7 through 10 are respectively diagrams showing the characteristics of important parts of the conventional control apparatus.
Figure 8:
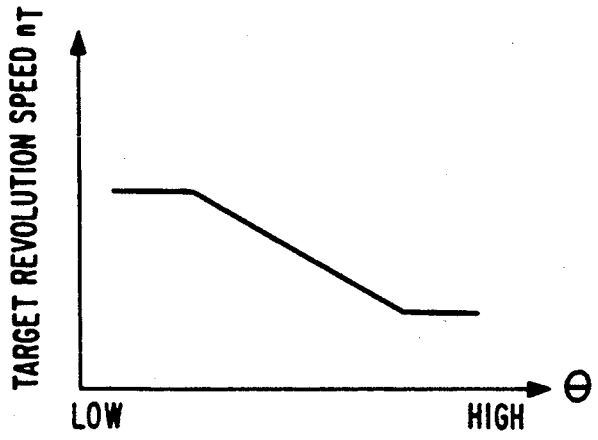
FIGURE 8 PRIOR ART
Figure 9:
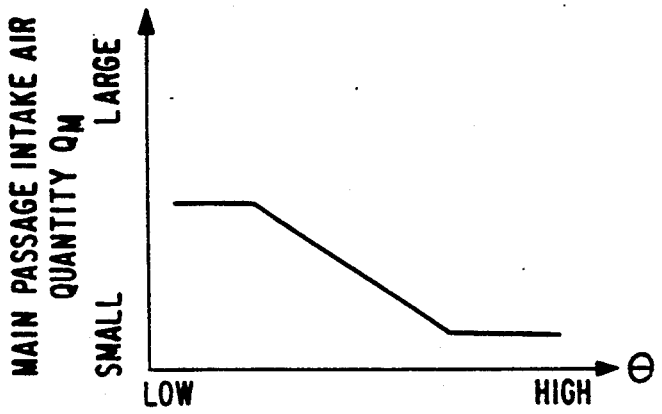
FIGURE 9 PRIOR ART
Figure 10:
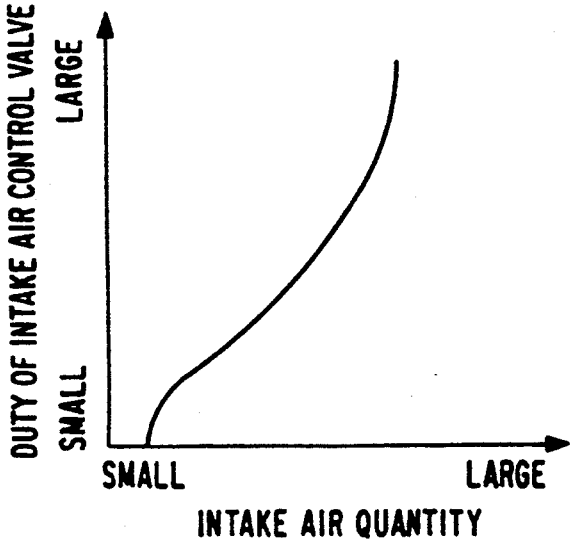
FIGURE 10 PRIOR ART

In FIG. 1, a reference numeral 37 designates a control/arithmetic section to receive a signal representing an intake air quantity error $\Delta\epsilon_Q$ and to output a Signal representing a corrected air flow quantity $\Delta Q$ and a symbol $S_2$ indicates a switch operable at a predetermined frequency so that the corrected air flow quantity $\Delta Q$ divided from the revolution speed feedback control quantity $Q_{NFB}$ is transferred to a correction value memory 38 during the operation of the switch $S_2$. The construction and arrangement of the revolution speed control apparatus of the first embodiment of the present invention is the same as that shown in FIG. 6.

Figure 3:
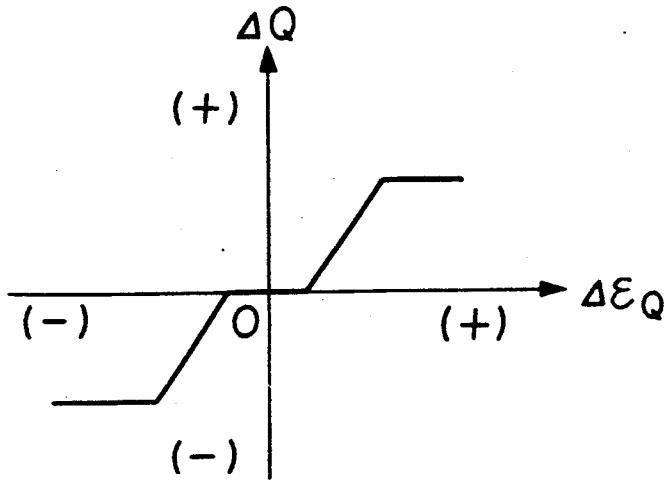
FIG. 3 is a diagram showing the characteristics of the control/arithmetic section of the control apparatus of the present invention.

The operation of the control apparatus having the construction as described above will be described. The target intake air quantity $Q_O$ is outputted from the node $N_2$ in the same manner as the conventional control apparatus. At the node $N_8$, an error is obtainable between the target intake air quantity $Q_O$ and the actual intake air quantity $Q_A$. The error is inputted into the control/arithmetic section 37. The control/arithmetic section 37 operates in such a manner that the corrected air flow quantity $\Delta Q$ is made large as the error between the target intake air quantity $Q_O$ and the actual intake air quantity $Q_A$, i.e. the intake air quantity error $\Delta\epsilon_Q$ is large, and the corrected air flow quantity $\Delta Q$ becomes zero at a region below the absolute value of $\Delta\epsilon_Q$, as shown in FIG. 3, and then, it outputs a signal indicating the corrected air flow quantity $\Delta Q$.

The switch $S_2$ operates at a predetermined frequency so that the corrected air flow quantity $\Delta Q$ divided from the revolution speed feedback control quantity from the calculating section 34 is transferred to and memorized in the correction value memory 38 at the operating time of the switch $S_2$.

Figure 4:
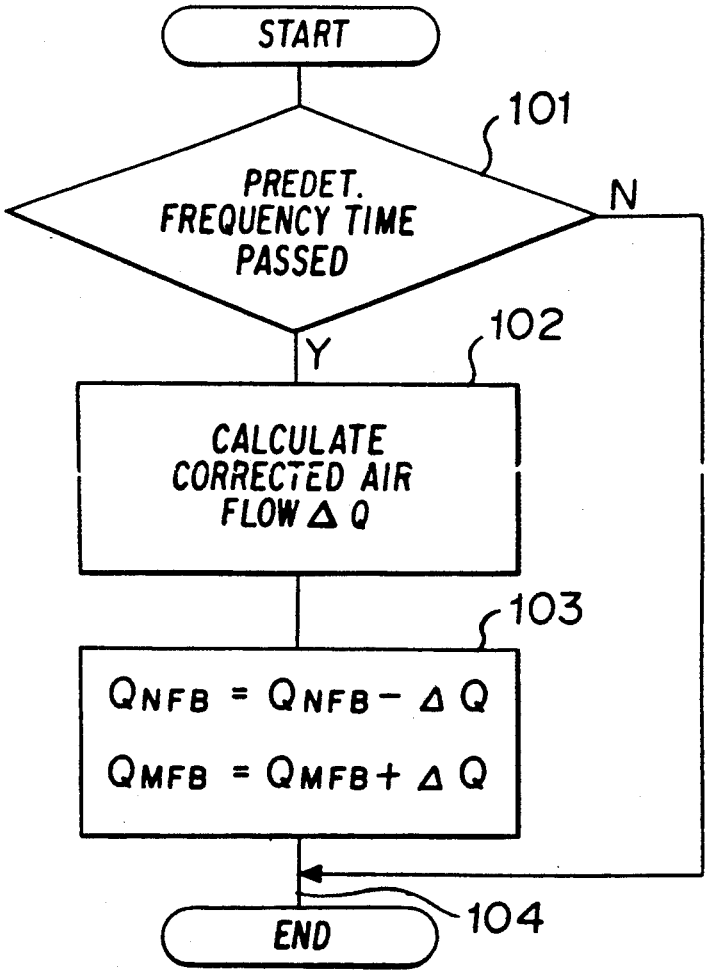
FIG. 4 is a flow chart showing the operation of important portion of the control apparatus according to the present invention.

The operation of the above-mentioned will be described with reference to a flow chart shown in FIG. 4.

At Step 101, determination is made as to whether or not a predetermined frequency time has passed. When the determination is negative, the operation of Step 104 is taken and the process is finished. On the other hand, when it is found that the predetermined frequency time has passed, the sequential step goes to Step 102 at which the corrected air flow quantity $\Delta Q$ is calculated on the basis of $\Delta\epsilon_Q$ in accordance with the characteristic diagram of FIG. 3, in the control/arithmetic section 37. Then, the corrected air flow quantity $\Delta Q$ is subtracted from the revolution speed feedback control quantity $Q_{NFB}$ of the calculating section 34 at Step 103, and the corrected air flow quantity $\Delta Q$ is added to a value $Q_{MFB}$ memorized in the correction value memory 38. Then, the sequential step is finished at Step 104.

The corrected memory value $Q_{MFB}$ is added to the target intake air quantity $Q_O$ at the node $N_4$. The following operations are the same as those in the conventional routine.

In the above-mentioned embodiment, the factor of error between the target revolution speed and the actual revolution speed is assigned to the revolution speed feedback control quantity $Q_{NFB}$ and the factor of error between the target intake air quantity and the actual intake air quantity is assigned to the corrected memory value $Q_{MFB}$ of the corrected value memory 38 in order to perform the control of the engine revolution speed. Although the above-mentioned embodiment of the present invention performs simultaneously the revolution speed feedback control and the intake air feedback control with improved controllability, it performs in fact only the revolution speed feedback control in the control system because $Q_{MFB}$ is obtained by the subtraction from $Q_{NFB}$. There is no reduction of the controllability caused by the mutual relation of the gains of the revolution speed feedback control and the intake air quantity feedback control.

Examples of the operations of the above-mentioned embodiment are shown in detail in Tables 1–3. The tables show changes of parameters wherein Table 1 shows data in a state that clogging takes place in the intake air quantity adjusting section 7, Table 2 shows data in a state that there is a change in the characteristics of the engine, and Table 3 shows data in a state that the clogging and the change of the characteristics simultaneously occur. From the Tables, it is understood that the factors of error are corrected separately with respect to $Q_{NFB}$ and $Q_{MFB}$.

TABLE 1

| | Clogging state | | | | | | | |
|---|---|---|---|---|---|---|---|---|
| | Set revolution speed $n_T$ | Actual revolution speed $n_e$ | Set intake air quantity $Q_T$ | Revolution speed feedback control quantity $Q_{NFB}$ | Corrected memory value $Q_{MFB}$ | Main passage intake air quantity $Q_M$ | Actual amin passage air quantity $Q_{RM}$ | Actual intake air quantity to engine $Q_A$ |
| Reference state | 750 rpm | 750 rpm | 3 g/s | 0 g/s | 0 g/s | 1 g/s | 1 g/s | 3 g/s |
| Initial state | 750 rpm | 650 rpm | 3 g/s | 0 g/s | 0 g/s | 1 g/s | 0 g/s | 2 g/s |
| Step 1 | 750 rpm | 750 rpm | 3 g/s | 1 g/s | 0 g/s | 1 g/s | 0 g/s | 3 g/s |
| Step 2 | 750 rpm | 750 rpm | 3 g/s | 0 g/s | 1 g/s | 1 g/s | 0 g/s | 3 g/s |

TABLE 2

| | Change of engine characteristics | | | | | | | |
|---|---|---|---|---|---|---|---|---|
| | Set revolution speed $n_T$ | Actual revolution speed $n_e$ | Set intake air quantity $Q_T$ | Revolution speed feedback control quantity $Q_{NFB}$ | Corrected memory value $Q_{MFB}$ | Main passage intake air quantity $Q_M$ | Actual amin passage air quantity $Q_{RM}$ | Actual intake air quantity to engine $Q_A$ |
| Reference state | 750 rpm | 750 rpm | 3 g/s | 0 g/s | 0 g/s | 1 g/s | 1 g/s | 3 g/s |
| Initial state | 750 rpm | 700 rpm | 3 g/s | 0 g/s | 0 g/s | 1 g/s | 1 g/s | 3 g/s |
| Step 1 | 750 rpm | 750 rpm | 3 g/s | 0.5 g/s | 0 g/s | 1 g/s | 1 g/s | 3.5 g/s |

TABLE 3

| | Clogging and change of engine characteristics | | | | | | | |
|---|---|---|---|---|---|---|---|---|
| | Set revolution speed $n_T$ | Actual revolution speed $n_e$ | Set intake air quantity $Q_T$ | Revolution speed feedback control quantity $Q_{NFB}$ | Corrected memory value $Q_{MFB}$ | Main passage intake air quantity $Q_M$ | Actual amin passage air quantity $Q_{RM}$ | Actual intake air quantity to engine $Q_A$ |
| Reference state | 750 rpm | 750 rpm | 3 g/s | 0 g/s | 0 g/s | 1 g/s | 1 g/s | 3 g/s |
| Initial state | 750 rpm | 600 rpm | 3 g/s | 0 g/s | 0 g/s | 1 g/s | 0 g/s | 2 g/s |
| Step 1 | 750 rpm | 750 rpm | 3 g/s | 1.5 g/s | 0 g/s | 1 g/s | 0 g/s | 3.5 g/s |
| Step 2 | 750 rpm | 750 rpm | 3 g/s | 0.5 g/s | 1 g/s | 1 g/s | 0 g/s | 3.5 g/s |

Figure 2:
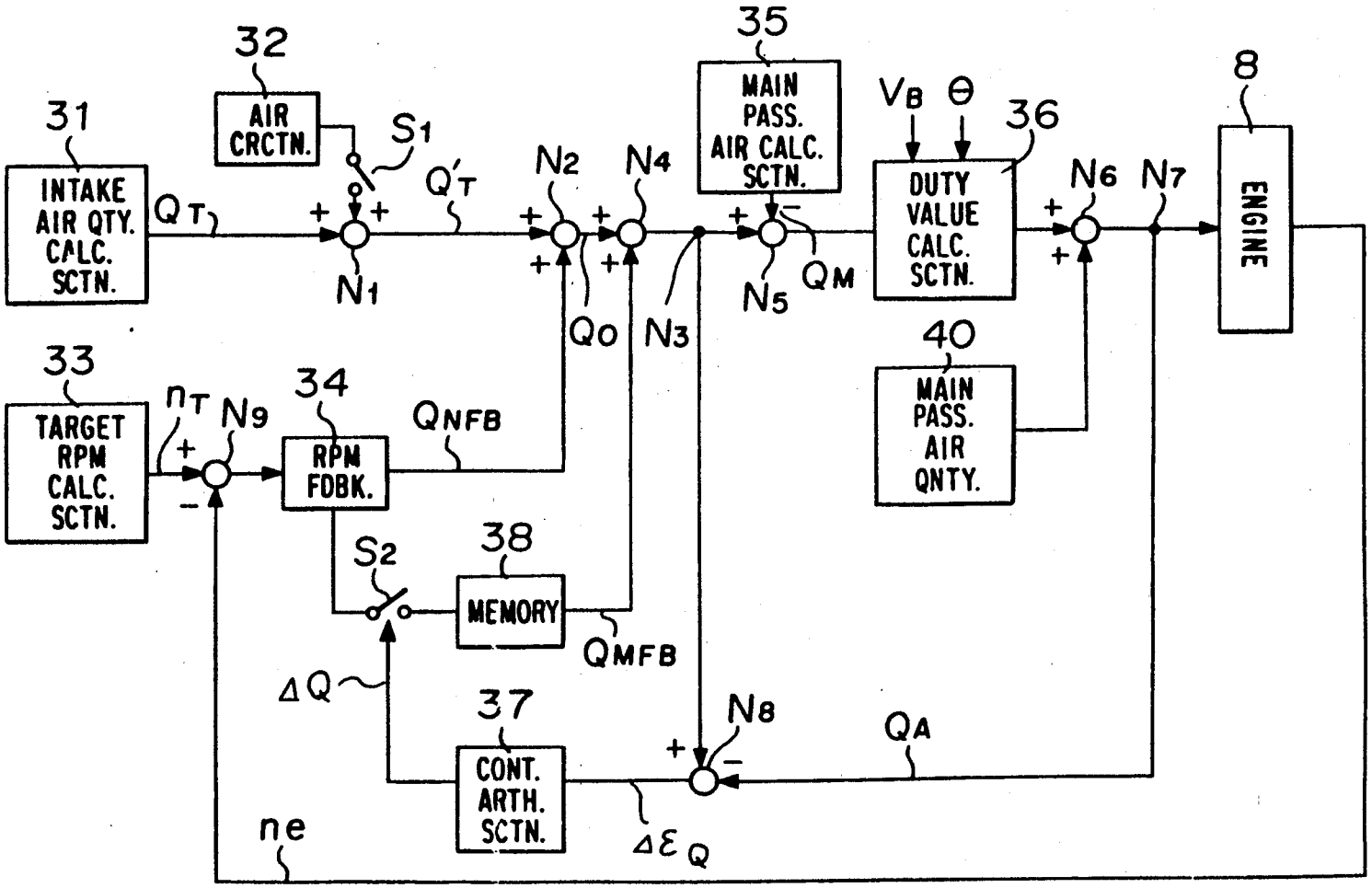

FIG. 2 is a block diagram showing a second embodiment of the revolution speed control apparatus according to the present invention.

In the second embodiment, the correction memory value $Q_{MFB}$ is added to the target intake air quantity $Q_O$ to obtain a summed value, and an error between the summed value and the actual intake air quantity $Q_A$ is inputted into the control/arithmetic section 37. In this embodiment, there may a case that the factor of error based on the difference between the target revolution speed and the actual revolution speed, and the factor of error based on the difference between the target intake air quantity and the actual intake air quantity are mixed incapable of separating. In this case, since the factor of error cannot be divided into $Q_{NFB}$ and $Q_{MFB}$, the controllability is somewhat poor in comparison with the embodiment as shown in FIG. 1. However, if the gain of $Q_{MFB}$ is sufficiently made smaller than that of $Q_{NFB}$, there is a possibility of utility in this embodiment.

Figure 5:
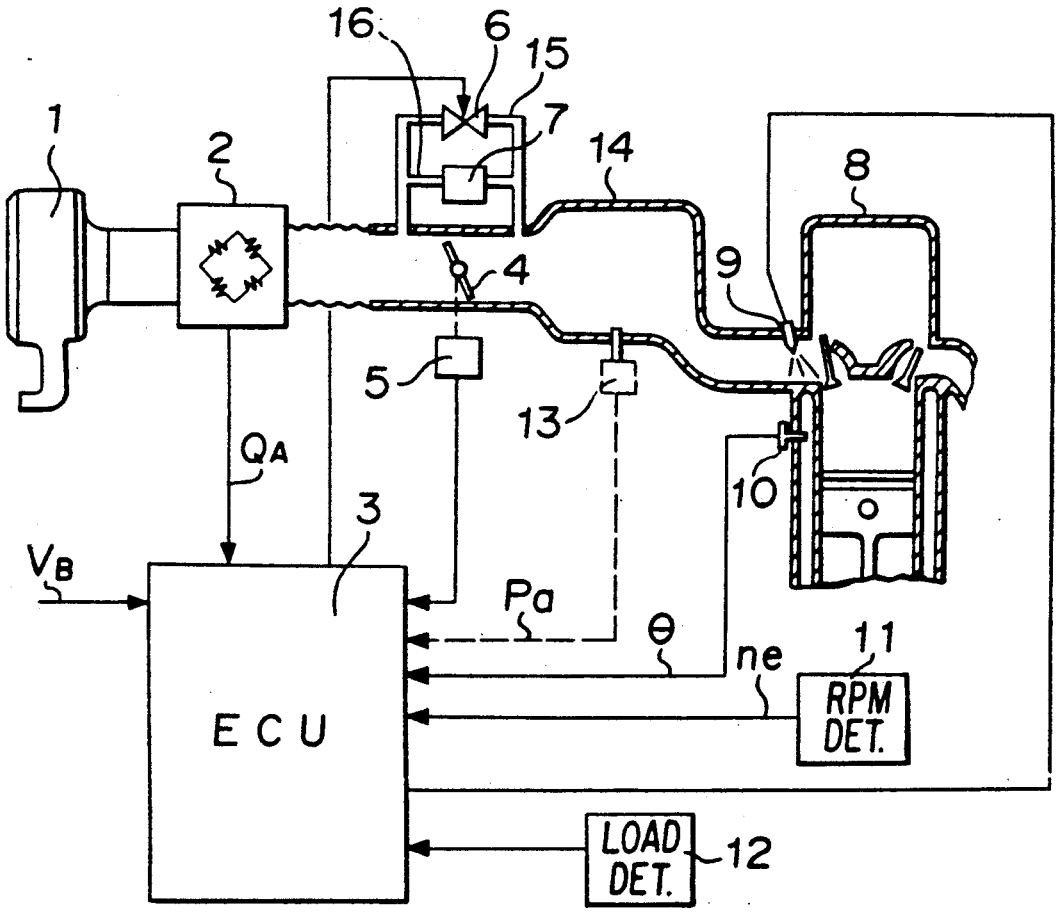
FIGURE 5 PRIOR ART
FIGS. 5 and 6 are respectively block diagrams of conventional revolution speed control apparatus for an internal combustion engine.

Referring to FIG. 5, a hot wire type air flow sensor 2 is used in order to obtain the intake air quantity $Q_A$. However, the intake air quantity $Q_A$ may be obtained by the calculation of a revolution speed $n_e$ and a pressure signal $P_a$ from the pressure sensor 13.

In accordance with the present invention, control of the intake air quantity to the engine is made by transferring with time the revolution speed feedback control quantity on the basis of the error between the target intake air quantity and the actual intake air quantity so that the intake air quantity is obtained from the target intake air quantity and the corrected memory value in correspondence to the revolution speed feedback control quantity. Accordingly the controllability can be improved because the factor of error is assigned to the revolution speed feedback control quantity and the corrected memory value. Further, since the renewal of the corrected memory value can be effected without affecting the control system, the optimum revolution speed feedback control and the intake air quantity feedback control can be attained without suffering the limitation of the control system.

Obviously, numerous modifications and variations of the present invention are possible in light of the above teachings. It is therefore to be understood that within the scope of the appended claims, the invention may be practiced otherwise than as specifically described herein.

What is claimed is:

1. A revolution speed control apparatus for an internal combustion engine which comprises:

an intake air quantity setting means for setting an intake air quantity to an internal combustion engine, a target revolution speed setting means for setting a target revolution speed for the engine, a revolution speed detecting means for detecting the revolution speed of the engine, an idling state detecting means for detecting an idling state of the engine, a revolution speed feedback-control quantity calculating means for calculating a revolution speed feedback control quantity in accordance with an error between the target revolution speed and an actual revolution speed of the engine when the engine is in an idling state, an intake air quantity detecting means for detecting an intake air quantity to the engine, a correction value memory to transfer with time the revolution speed feedback control quantity in accordance with an error between an actual intake air quantity and a target intake air quantity which is obtained from the intake air quantity set by the intake air quantity setting means and the revolution speed feedback control quantity, and an intake air quantity control means for controlling the intake air quantity on the basis of a memory value stored in the correction value memory and the target intake air quantity.

2. The revolution speed control apparatus according to claim 1, wherein a control/arithmetic section receives the error between the target and actual intake air quantities to operate it thereby outputting a corrected flow rate $\Delta Q$ which is used for subtracting from the revolution speed feedback control quantity.

* * * * *